US006837206B2

(12) United States Patent
Bonde et al.

(10) Patent No.: US 6,837,206 B2
(45) Date of Patent: Jan. 4, 2005

(54) CRANKCASE COVER WITH OIL PASSAGES

(75) Inventors: Kevin G. Bonde, Kiel, WI (US); William D. Koenigs, Fond du Lac, WI (US)

(73) Assignee: Kohler Co., Kohler, WI (US)

( * ) Notice: Subject to any disclaimer, the term of this patent is extended or adjusted under 35 U.S.C. 154(b) by 16 days.

(21) Appl. No.: 10/194,203

(22) Filed: Jul. 11, 2002

(65) Prior Publication Data

US 2004/0007198 A1 Jan. 15, 2004

(51) Int. Cl.[7] ..... F02F 7/00
(52) U.S. Cl. ..... 123/195 C; 123/195 HC; 123/196 W
(58) Field of Search ..... 123/195 C, 195 HC, 123/196 W

(56) References Cited

U.S. PATENT DOCUMENTS

| | | | |
|---|---|---|---|
| 1,172,612 | A | 2/1916 | Kremer |
| 1,301,007 | A | 4/1919 | Roof |
| 1,410,019 | A | 3/1922 | Krause |
| 1,469,063 | A | 9/1923 | Wills |
| 1,590,073 | A | 6/1926 | Birkigt |
| 1,684,955 | A | 9/1928 | Goodwin |
| 2,235,160 | A | 3/1941 | Ljungstrom |
| 2,459,594 | A | 1/1949 | Smith |
| 3,118,433 | A | 1/1964 | Lechtenberg |
| 3,195,526 | A | 7/1965 | Jordan |
| 3,200,804 | A | 8/1965 | Hensler et al. |
| 3,314,408 | A | 4/1967 | Fenton |
| 3,407,741 | A | 10/1968 | Weber et al. |
| 3,457,804 | A | 7/1969 | Harkness |
| 3,561,416 | A | 2/1971 | Kiekhaefer |
| 3,751,080 | A | 8/1973 | Bailey et al. |
| 3,818,577 | A | 6/1974 | Bailey et al. |
| 4,030,179 | A | 6/1977 | Schwarz |
| 4,097,702 | A | 6/1978 | Halsted |
| 4,185,717 | A | 1/1980 | Ford, Jr. et al. |
| 4,193,310 | A | 3/1980 | Boyer et al. |
| 4,198,879 | A | 4/1980 | Hornak et al. |
| 4,283,607 | A | 8/1981 | Brightman |
| 4,285,309 | A | 8/1981 | Johansson |

(List continued on next page.)

FOREIGN PATENT DOCUMENTS

| | | |
|---|---|---|
| DE | 3120190 A1 | 5/1982 |
| GB | 355365 | 8/1931 |
| GB | 378216 | 8/1932 |
| WO | WO 86/04122 A1 | 7/1986 |
| WO | WO 00/43655 A1 | 7/2000 |

OTHER PUBLICATIONS

Ten photographs of Kawasaki FJ180V engine, taken in Apr., 2004 (the first nine photos) and 2003 (the final photo).

"Technical Innovations—Briggs & Stratton extends engine life", SAE Off–Highway Engineering, Oct. 2001, p. 4.

*Primary Examiner*—Noah P. Kamen
(74) *Attorney, Agent, or Firm*—Quarles & Brady LLP

(57) ABSTRACT

A cover for a crankcase of an internal combustion engine is disclosed. The cover has an inside surface in which walls are formed extending from the inside surface to form channels. A plate covers the channels to form passages that allow the flow of oil from various inlets to various outlets in the passages, but does not necessarily completely seal the channels. The plate is secured to the inside surface of the cover by threaded members that are inserted through fastening apertures in the plate and are threaded into corresponding internally threaded apertures in the inside surface of the cover.

29 Claims, 5 Drawing Sheets

U.S. PATENT DOCUMENTS 4,308,830 A 1/1982 Yamada et al.
4,332,222 A 6/1982 Papez
4,336,777 A 6/1982 Yanagihara et al.
4,366,787 A 1/1983 Gale
4,372,258 A 2/1983 Iwai
4,380,216 A 4/1983 Kandler
4,391,231 A 7/1983 TateBe et al.
4,401,067 A 8/1983 Honda
4,414,934 A 11/1983 Vogl et al.
4,422,348 A 12/1983 Campbell
4,433,651 A 2/1984 Nakakita et al.
4,446,828 A 5/1984 Bauder et al.
4,452,194 A 6/1984 Watanabe
4,458,555 A 7/1984 Holtzberg et al.
4,507,917 A 4/1985 Kandler
4,510,897 A 4/1985 Hatz et al.
4,530,318 A 7/1985 Semple
4,534,241 A 8/1985 Remmerfelt et al.
4,548,253 A 10/1985 Funatani et al.
4,569,109 A 2/1986 Fetouh
4,570,584 A 2/1986 Uetsuji et al.
4,617,122 A 10/1986 Kruse et al.
4,622,933 A 11/1986 Fukuo et al.
4,644,912 A 2/1987 Umeha et al.
4,656,981 A 4/1987 Murata et al.
4,660,512 A 4/1987 Binder et al.
4,672,930 A 6/1987 Sumi
4,674,455 A 6/1987 Tsuboi
4,684,267 A 8/1987 Fetouh
4,688,446 A 8/1987 Ishikawa
4,691,590 A 9/1987 Geringer et al.
4,696,266 A 9/1987 Harada
4,711,823 A 12/1987 Shiina
4,716,861 A 1/1988 Fujikawa et al.
4,736,717 A 4/1988 Fujikawa et al.
4,793,297 A 12/1988 Fujii et al.
4,802,269 A 2/1989 Mukai et al.
4,811,705 A 3/1989 Ono et al.
4,819,592 A 4/1989 van Ligten
4,819,593 A 4/1989 Bruener et al.
4,822,414 A 4/1989 Yoshikawa et al.
4,828,632 A 5/1989 Adam et al.
4,834,784 A 5/1989 Bidanset
4,836,045 A 6/1989 Lobig
4,838,909 A 6/1989 Bidanset
4,853,179 A 8/1989 Shiina
4,862,981 A 9/1989 Fujikawa et al.
4,867,806 A 9/1989 Shiina
4,890,584 A 1/1990 Tamba et al.
4,892,068 A 1/1990 Coughlin
4,898,133 A 2/1990 Bader
4,909,197 A 3/1990 Perr
4,926,814 A 5/1990 Bonde
4,928,550 A 5/1990 Sakai et al.
4,928,651 A * 5/1990 Kronich ..... 123/196 W
4,934,442 A 6/1990 Futamura et al.
4,949,687 A 8/1990 Emmersberger
4,958,537 A 9/1990 Diehl et al.
4,964,378 A 10/1990 Tamba et al.
4,986,224 A 1/1991 Zuffi
5,002,023 A 3/1991 Butterfield et al.
5,038,727 A 8/1991 Burns et al.
5,057,274 A 10/1991 Futamura et al.
5,065,720 A 11/1991 Nishiyama et al.
5,067,933 A 11/1991 Hardesty et al.
5,085,184 A 2/1992 Yamada et al.
RE33,978 E 6/1992 Shirai
5,152,264 A 10/1992 Evans
5,163,341 A 11/1992 Murrish et al.
5,197,422 A 3/1993 Oleksy et al.
5,197,425 A 3/1993 Santi
5,207,120 A 5/1993 Arnold et al.
5,241,873 A 9/1993 Hormann
5,243,878 A 9/1993 Santi
5,265,700 A 11/1993 Santi
5,282,397 A 2/1994 Harkness et al.
5,323,745 A 6/1994 Sato et al.
5,357,917 A 10/1994 Everts
5,370,093 A 12/1994 Hayes
5,375,571 A 12/1994 Diehl et al.
5,421,297 A 6/1995 Tamba et al.
5,463,809 A 11/1995 Hoffman et al.
5,497,735 A 3/1996 Kern et al.
5,555,776 A 9/1996 Gazza
5,556,441 A 9/1996 Courtwright et al.
5,560,333 A 10/1996 Genouille
5,606,943 A 3/1997 Tamba et al.
5,615,586 A 4/1997 Phillips et al.
5,640,936 A 6/1997 Hudson
5,651,336 A 7/1997 Rygiel et al.
5,711,264 A 1/1998 Jezek et al.
5,722,295 A 3/1998 Sakai et al.
5,809,958 A 9/1998 Gracyalny
5,823,153 A 10/1998 Santi et al.
5,863,424 A 1/1999 Lee
5,887,678 A 3/1999 Lavender
5,904,124 A 5/1999 Poehlman et al.
5,960,763 A * 10/1999 Yamamura ..... 123/195 C
5,964,198 A 10/1999 Wu
5,979,392 A 11/1999 Moorman et al.
5,988,135 A 11/1999 Moorman et al.
6,006,721 A 12/1999 Shannon et al.
6,047,667 A 4/2000 Leppanen et al.
6,055,952 A 5/2000 Gau
6,056,874 A 5/2000 Goodman
6,076,426 A 6/2000 Genouille
6,109,230 A 8/2000 Watanabe et al.
6,116,205 A 9/2000 Troxler et al.
6,126,499 A 10/2000 Katayama et al.
6,170,449 B1 1/2001 Saiki et al.
6,213,081 B1 4/2001 Ryu et al.
6,269,786 B1 8/2001 Snyder et al.
6,293,981 B1 9/2001 Holderle et al.
6,305,242 B1 10/2001 Smith et al.
6,395,049 B2 5/2002 Knodler et al.
6,422,193 B2 7/2002 Kawamoto

* cited by examiner

CRANKCASE COVER WITH OIL PASSAGES

FIELD OF THE INVENTION

The present invention relates to internal combustion engines. In particular, the present invention relates to covers for crankcases within internal combustion engines and the oil passages with the covers.

BACKGROUND OF THE INVENTION

Internal combustion engines contain a crankcase, which typically houses many of the internal workings of the engine such as the crankshaft, cams, counterweights, and various gears. The crankcase is also used to collect and hold the oil or other lubricant used in the engine. The accumulated oil is transferred from the crankcase, typically through an oil filter, is delivered to various engine parts for lubrication, and is then returned to the crankcase.

Many engines currently use splash lubrication and/or rolling element bearings to deliver oil from the crankcase to the various engine parts. These methods are typically used because they are fairly simple and avoid the complexity of full pressure oil circuits. However, the disadvantage of these methods is that they do not have the capacity of full pressure oil circuits and typically suffer from higher wear. Therefore, it is desirable to use a full pressure oil circuit to maintain the capacity and durability of the oil delivery system.

A full pressure oil circuit typically delivers oil from an oil pump to various engine parts under pressure. In order to do this, the circuit that the oil follows must be enclosed as to maintain the oil under pressure throughout the oil circuit.

One way to create a full pressure oil circuit in an internal combustion engine is to create passages within the crankcase itself. Two designs for this type of oil circuit are disclosed in U.S. Pat. No. 4,285,309, which issued on Aug. 25, 1981, to Rolf A. G. Johansson, and U.S. Pat. No. 4,926,814, which issued on May 22, 1990, to Kevin G. Bonde. In both of these patents, there are passages integral to the crankcase itself.

In the Johansson patent, channels are made in the upper surface of the crankcase. Similarly, in the Bonde patent, multiple walls are formed in the top wall of the crankcase defining multiple channels. In both patents, the channels are then enclosed when the crankcase is assembled with an upper housing forming multiple passages. However, the designs in both the Johansson and the Bonde patents have certain disadvantages. In particular, if the upper housing and the upper surface of the crankcase do not fit perfectly, there will be some leaking of the oil. In these designs, any oil that leaks will leak out of the crankcase and be lost.

Another disadvantage is that the channels in both designs must either be machined into the upper portion of the crankcase or be molded integral with the crankcase. If the channels are machined, at least one additional step is added to the manufacture of the crankcase, which costs extra time and expense. If the channels are molded integral with the crankcase, the die for the crankcase becomes more complicated and costly and may require die-slides that will increase the cost of the die itself and will not allow dies for multiple parts. In addition, once the basic shapes of the channels are formed, there may be additional machining steps required to complete the full passages.

One way to overcome these disadvantages is to create passages within the crankcase cover rather than the crankcase itself. By having the passages in the crankcase cover, any oil that may leak from the passages is returned to the crankcase rather than leaking out of the crankcase and being lost. In addition, the manufacture of the crankcase itself is not complicated by requiring large upper surfaces, extra machining steps, or complicated and inefficient die molds.

One common way to create passages with a cover is to use oil tubes that are cast directly into the cover. However, molding a cover using cast in oil tubes is an extremely complex process, is expensive, and can lead to poor quality such as porosity around the oil tubes. In addition, once the cover has been cast with the oil tubes, the cover requires extra machining to eliminate any burrs on the oil tubes and many designs require extremely long drillings in order to complete the full oil circuit. Finally, the mold dies required for crankcase covers with cast in oil tubes are typically expensive and complicated because they require die-slides, they do not allow for molding multiple parts on a single die tool, and the molding procedures are complicated.

It would therefore be advantageous if a crankcase cover could be designed that contained passages that allowed the use of a full pressure oil circuit without the use of cast in oil tubes. In particular, it would be advantageous if the crankcase cover was easily manufactured, without the need for extra machining steps or long drillings, and could be manufactured with simple mold dies which do not include die-slides and allow for the manufacture of multiple parts on a single mold die to simplify and reduce the cost of the manufacture of the cover.

SUMMARY OF THE INVENTION

The present inventors have discovered a crankcase cover design that can be used in a full pressure oil circuit in which multiple walls are molded directly into the cover itself forming multiple channels. The channels are then enclosed by a plate that is secured to the cover thereby forming multiple passages within the cover. Because the passages are formed in the cover, any oil that may leak from the passages is merely returned to the crankcase to be reused rather than leaking out of the crankcase all together. In addition, because the channels are formed by walls molded into the cover, the manufacture of the cover is simplified and the cost of manufacture is reduced. The mold die can be a simple open and close die that does not require any die-slides, molded in parts, or other complicated molding procedures, multiple parts can be made from a single mold die for better casting economy, and no extra machining steps or complicated drillings are required.

In particular, the present invention relates to a cover for the crankcase of an internal combustion engine that has a channel formed in the inside surface of the cover body and a means for covering the channel to form a passage that has an inlet and an outlet.

The present invention further relates to a crankcase of an internal combustion engine that has a body formed by a floor and side walls. The floor and side walls define an interior volume. The floor and each of the side walls has an interior surface facing the interior volume and the side walls each have an end surface opposite the floor. The end surfaces of the side walls define an opening in the body which is covered by a cover body having an inside surface facing the interior volume. The cover has a channel formed in the inside surface of the cover and a means for covering the channel to form a passage that has an inlet and an outlet.

DETAILED DESCRIPTION OF THE PREFERRED EMBODIMENT

Figure 1:
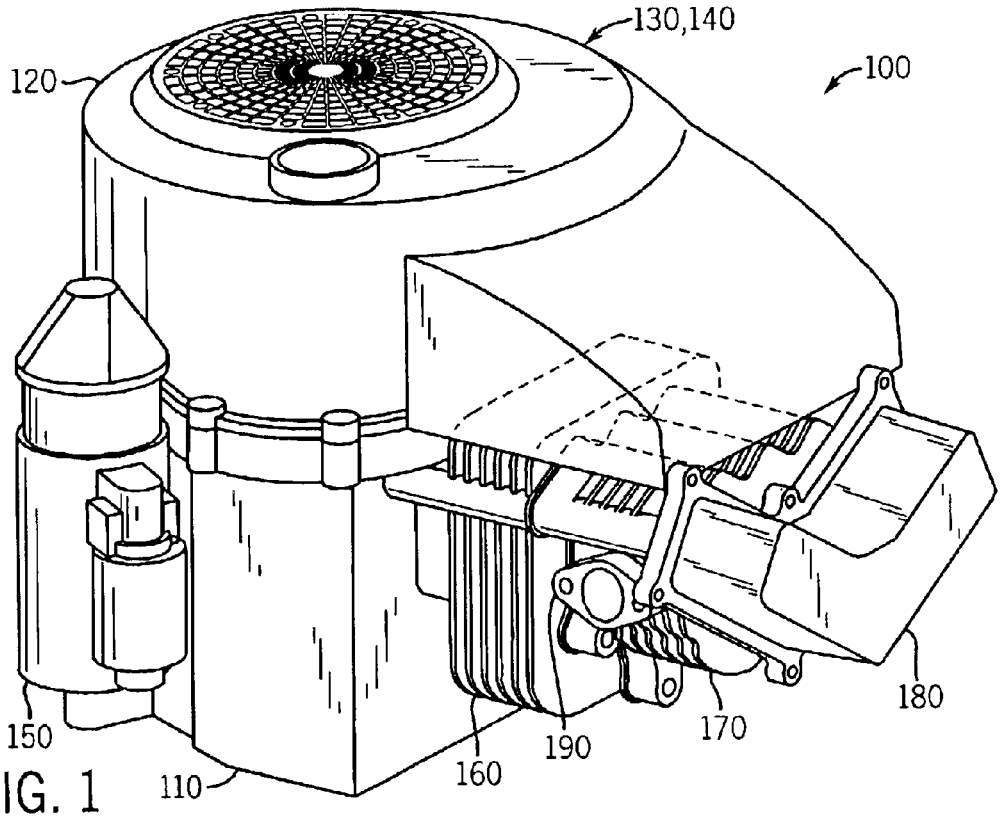
FIG. 1 is a first perspective view of a single cylinder engine, taken from a side of the engine on which are located a starter and cylinder head.
Figure 2:
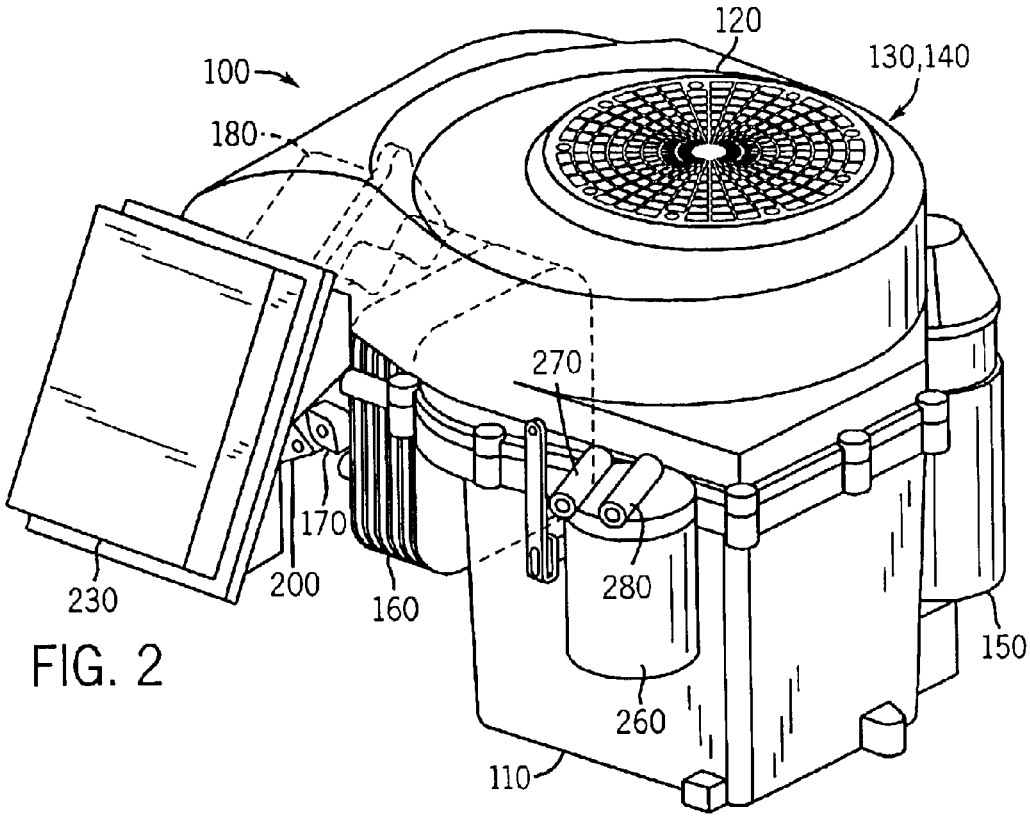
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIGS. 1 and 2 and an air intake port 200 shown in FIGS. 2 and 3. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder 160 through the cylinder head 170 and then out of the air exhaust port 190. The inflow and outflow of air into and out of the cylinder 160 by way of the cylinder head 170 is governed by an input valve 240 and an output valve 250, respectively (see FIG. 7). Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter 260 and then is returned from the oil filter 260 to the crankcase 110.

Figure 3:
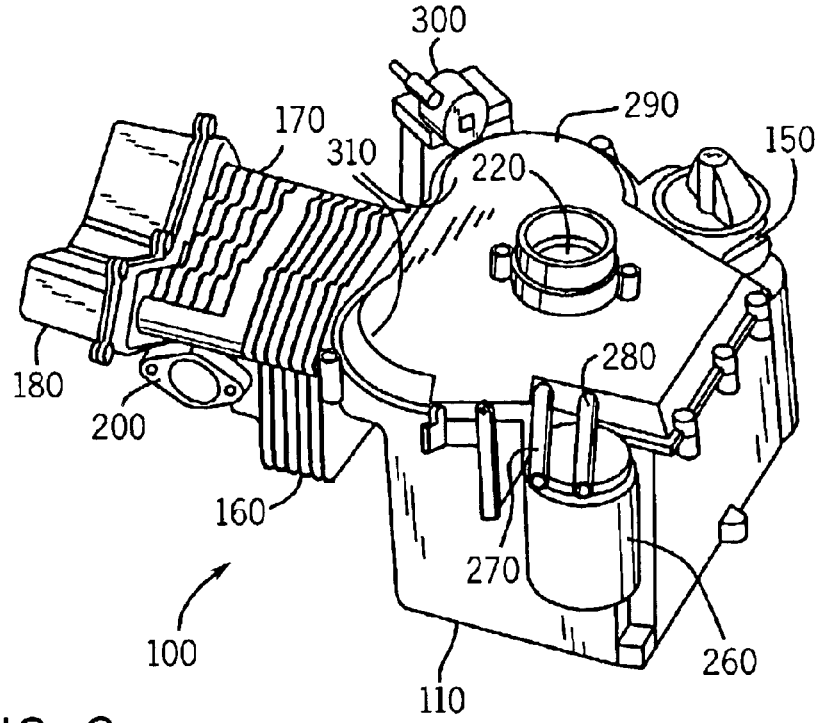
FIG. 3 is a third perspective view of the single cylinder engine of FIG. 1, in which certain parts of the engine have been removed to reveal additional internal parts of the engine.
Figure 4:
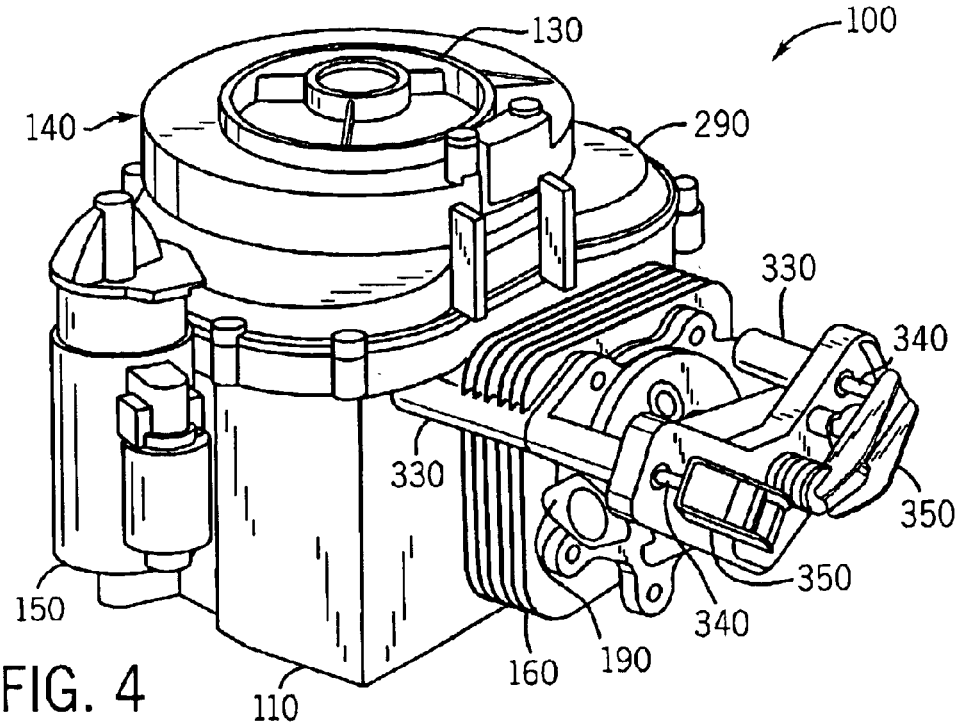
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a cover 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the cover 290 of the crankcase 110 is shown to have a pair of lobes 310 that cover a pair of gears 320 (see FIGS. 5 and 7–8). With respect to FIG. 4, the fan 130 and the flywheel 140 are shown above the cover 290 of the crankcase 110. Additionally, FIG. 4 shows the engine 100 without the cylinder head 170 and without the rocker arm cover 180, to more clearly reveal a pair of tubes 330 through which extend a pair of respective push rods 340. The push rods 340 extend between a pair of respective rocker arms 350 and a pair of cams (not shown) within the crankcase 110, as discussed further below.

Figure 5:
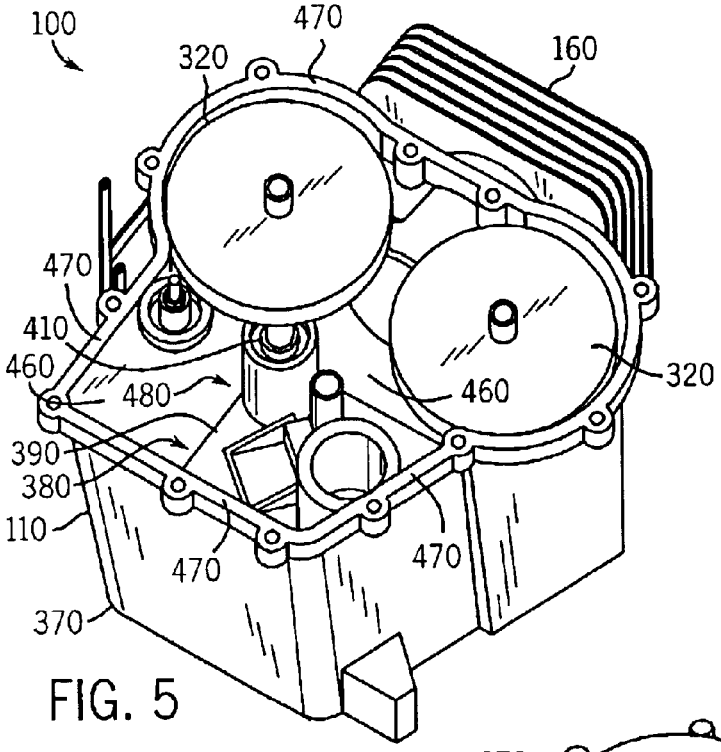
FIG. 5 is fifth perspective view of portions of the single cylinder engine of FIG. 1, in which a top of the crankcase has been removed to reveal an interior of the crankcase.
Figure 6:
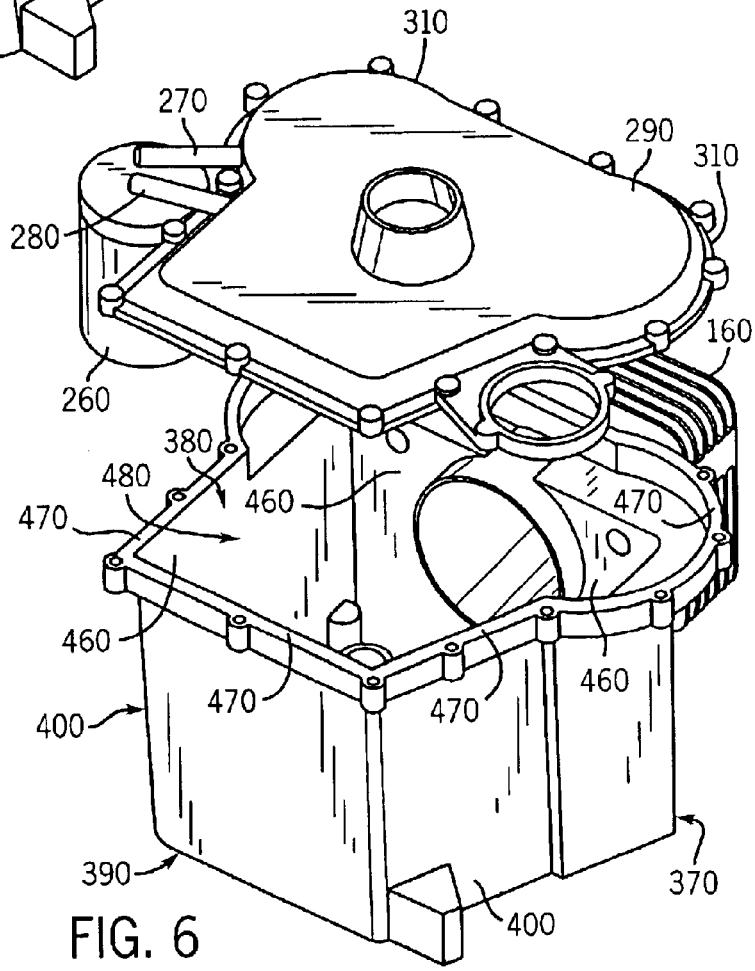
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the cover 290 of the crankcase 110 removed from a body 370 of the crankcase 110 to reveal an interior volume 380 of the crankcase. Additionally in FIGS. 5 and 6, the engine 100 is shown in cut-away to exclude portions of the engine that extend beyond the cylinder 160 such as the cylinder head 170. With respect to FIG. 6, the cover 290 of the crankcase 110 is shown above the body 370 of the crankcase 110 in an exploded view. In this embodiment, the body 370 includes a floor 390 and side walls 400. The side walls 400 of the crankcase 110 each have and interior surface 460 facing the interior volume 380 and an end surface 470 opposite and facing away from the floor 390. The end surfaces 470 of the side walls 400 together define an opening 480 in the body 370 of the crankcase 110. The cover 290 only acts as the roof of the crankcase 110 by covering the opening 480. The cover 290 and body 370 are manufactured as two separate pieces such that, in order to open the crankcase 110, one physically removes the cover 290 from the body 370. Also, as shown in FIG. 5, the pair of gears 320 within the crankcase 110 are supported by and rotate upon respective shafts 410, which in turn are supported by the body 370 of the crankcase 110.

Figure 7:
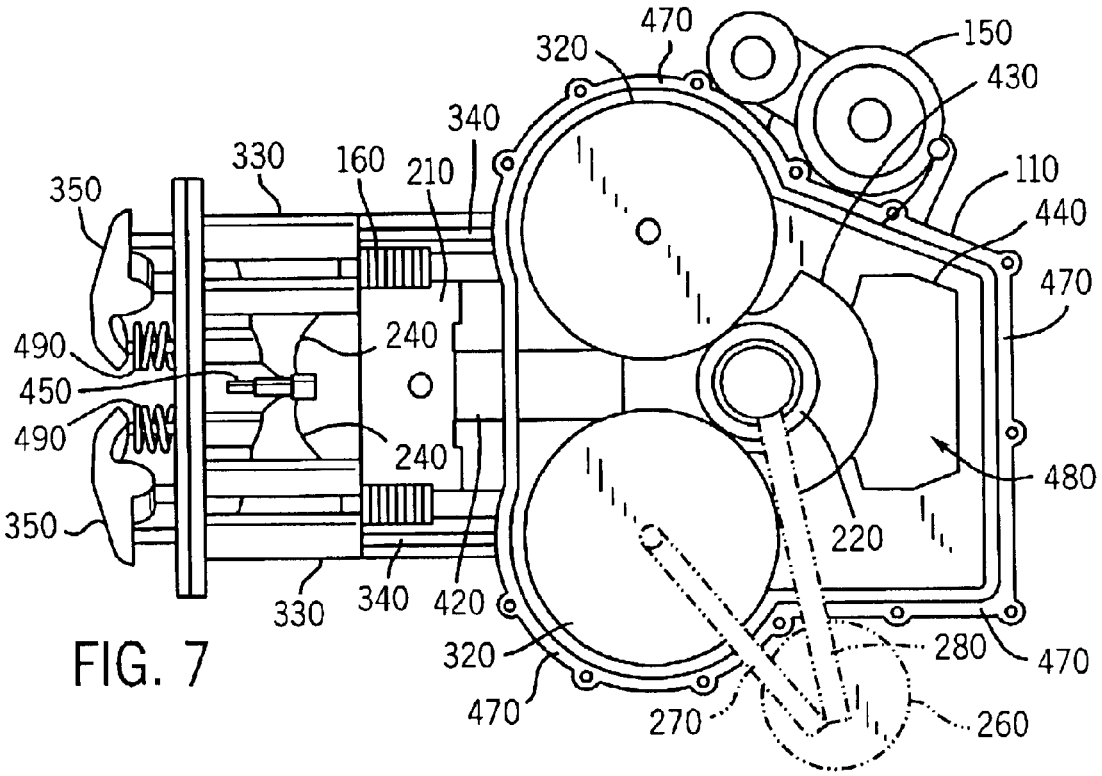
FIG. 7 is a top view of the single cylinder engine of FIG. 1, showing internal components of the engine in grayscale.

Referring to FIG. 7, a top view of the engine 100 is provided in which additional internal components of the engine are shown in grayscale. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears. In the present embodiment, the shafts 410 upon which the gears 320 are supported are capable of communicating oil from the floor 390 of the crankcase 110 (see FIG. 5) upward to the gears 320. The incoming line 270 to the oil filter 260 is coupled to one of the shafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams could be located above the gears 320 rather than underneath the gears.

Figure 8:
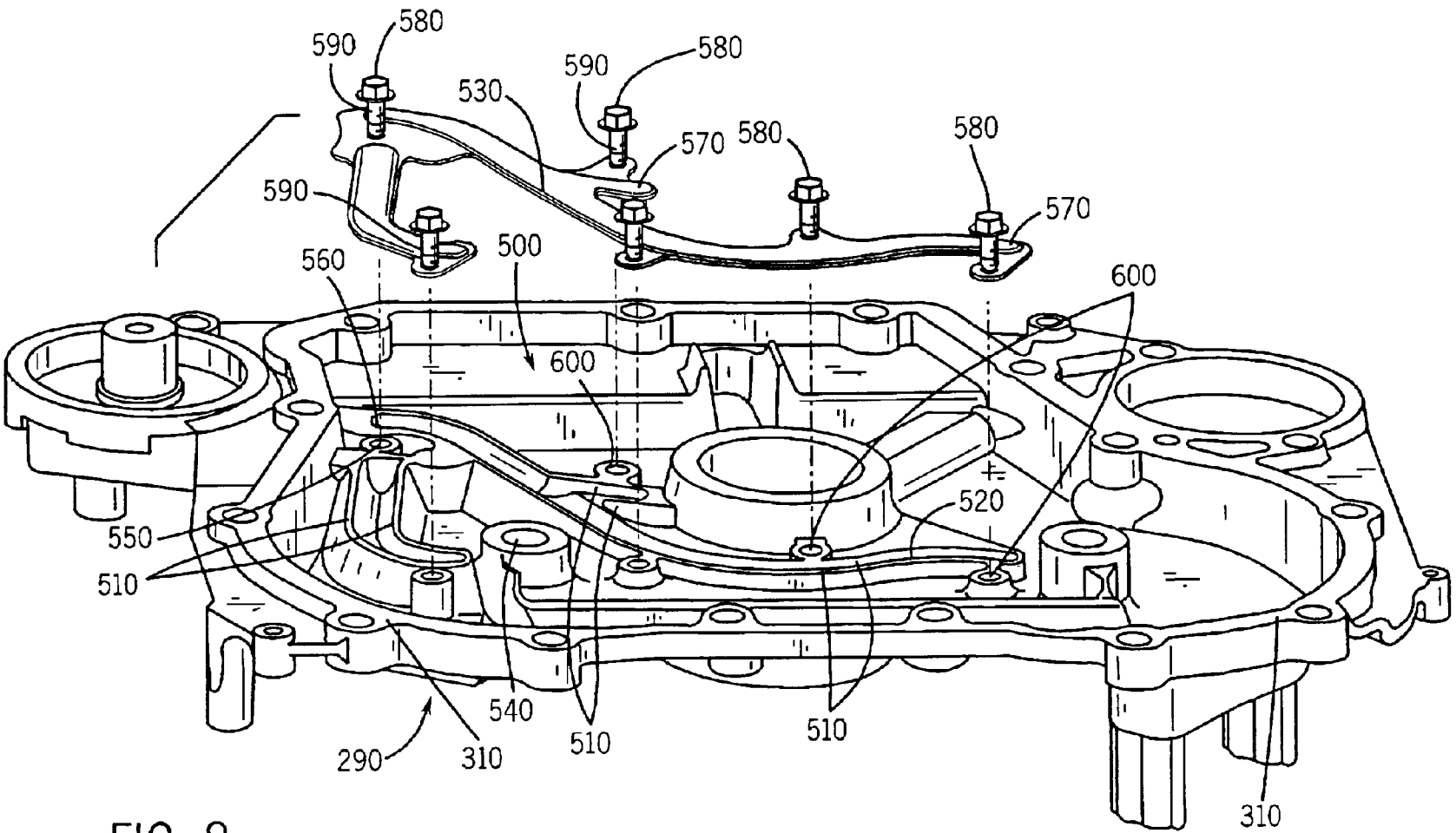
FIG. 8 is a first perspective view of a crank case cover of the single cylinder engine of FIG. 1.

Referring to FIG. 8, a perspective view of the cover 290 is shown. The cover 290 has an inside surface 500 that faces the interior volume 380 when the cover 290 is assembled to the crankcase 110. Walls 510 are molded directly into the cover 290 and extend from the inside surface 500 towards the interior volume 380, forming channels 520 in the inside surface 500. A plate 530 completely covers the channels 520 and forms passages (not shown) that allow the flow of oil or other fluids. The plate 530 does not necessarily have to completely seal the channels 520 because there is little consequence to minor leaking as any oil or other fluid that leaks from the passages will be returned to the crankcase 110. Threaded members 580, such are screws or bolts, are assembled through fastening apertures 590 in the plate 530 and thread into internally threaded apertures 600, which are molded directly into the cover 290, to secure the plate 530 to the inside surface 500 of the cover 290. In alternate embodiments of the invention, other methods of securing the plate 530 to the inside surface 500 could be used, such as welding, adhesive, rivets, etc.

The passages allow the flow of oil or other fluids from the shafts 410, through the oil filter 260, and to crankshaft 110 and gears 320. In addition, by varying the number and path of the passages, oil or other fluids could be distributed to any engine part requiring lubrication. Oil from one of the shafts 410 passes through a first inlet 540 in one passage, through the passage itself, and through an outlet 550 from the passage leading to the incoming line 270 of the oil filter 260. From the oil filter 260, the oil passes through the outlet line 280, through a second inlet 560 in a second passage, through the passage itself, and is distributed to the crankshaft 110 and gears 320 via apertures 570 in the plate 530. In alternate embodiments of the invention, other methods of distributing the oil or other fluid from the passages to various engine parts could also be used such as the use of nozzles, tubes, or other distribution devices.

In the present embodiment, the crankcase cover 290 has been designed for use with a single cylinder, 4-stroke, internal combustion engine. In alternate embodiments of the invention, the cover 290 can be used with any type of internal combustion engine by varying the number and path of the passages to distribute the oil or other fluid to various engine parts.

While the foregoing specification illustrates and describes the preferred emodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. An internal combustion engine, comprising:

a) a crankcase having a body formed by a floor and a plurality of side walls, the floor and side walls defining an interior volume;

b) the side walls having an interior surface facing the interior volume and an end surface opposite the floor;

c) the end surfaces of the side walls defining an opening in the body;

d) a cover covering the opening, the cover having an inside surface facing the interior volume, and having an internally threaded aperture;

e) a channel formed by a plurality of walls extending from the cover inside surface;

f) a plate, covering the channel to form a passage having an inlet and an outlet to allow the flow of fluid through the passage from the inlet to the outlet, and having a fastening aperture aligned with the internally threaded aperture;

g) a threaded member, inserted through the fastening aperture, and threaded into the internally threaded aperture to secure the plate to the inside surface of the cover; and h) the inlet and the outlet being formed by at least one aperture in the passage.

2. A method of manufacturing a crankcase having a capability of conducting lubricant along a top portion of the crankcase, the method comprising:

providing a bottom portion of a crankcase;

providing the top portion of the crankcase, wherein the top portion is capable of being assembled to and removed from the bottom portion of the crankcase, wherein the top portion includes at least one channel that extends along at least one portion of a first surface of the top portion; and coupling an additional component to the first surface of the top portion so that at least a portion of the channel is covered to form a passage that extends along the at least one portion of the first surface, wherein the first surface is directed toward an interior of the crankcase when the top portion and bottom portion are assembled to form the crankcase, such that any lubricant that leaks from the passage between the channel and the additional component leaks into the interior of the crankcase.

3. The method of claim 2, wherein the top portion is molded to include the at least one channel, and wherein the at least one channel couples at least two engine components selected from the group consisting of a crankshaft bearing, a camshaft bearing, and an oil filter.

4. A lid for a crankcase, the lid comprising:

a main lid portion having an interior surface and an exterior surface, wherein the lid is configured to be coupled to a remainder of the crankcase, and wherein the interior surface faces an interior of the crankcase when the lid is so coupled; and an additional portion that is affixed to the main lid portion along the interior surface, wherein at least one groove is provided along at least one of the interior surface of the main lid portion and an additional surface along the additional portion, the additional surface facing the interior surface when the main lid portion and the additional portion are affixed to one another, and wherein, when the main lid portion and the additional portion are affixed to one another, the at least one groove is covered over to form at least one passage extending along and between the interior and additional surfaces.

5. The lid of claim 4, wherein the at least one passage couples at least two engine components selected from the group consisting of a crankshaft bearing, a camshaft bearing, and an oil filter.

6. A crankcase assembly comprising:

a top of a crankcase housing that is at least one of integrally formed with a remainder of the crankcase housing and configured to interface the remainder of the crankcase housing; and a structure capable of being coupled to the top so that the structure directly interfaces the top, wherein at least one of the top and the structure includes a channel, and wherein when the structure is coupled to the top so that the structure directly interfaces the top, the channel is at least partly enclosed by the structure and top so as to form a passage.

7. A top for a crankcase of an internal combustion engine, said top comprising:

a) a body having a surface, an internally threaded aperture, and a plurality of walls extending from the surface of the body to form a channel;

b) a plate, covering the channel to form a passage having an inlet and an outlet to allow the flow of fluid through the passage from the inlet to the outlet, and having a fastening aperture aligned with the internally threaded aperture;

c) a threaded member, inserted through the fastening aperture, and threaded into the internally threaded aperture to secure the plate to the body; and d) the inlet and the outlet being formed by an aperture in the passage.

8. An internal combustion engine, comprising:

a) a crankcase having a body formed by a floor and a plurality of side walls, the floor and the side walls defining an interior volume;

b) the side walls having an interior surface facing the interior volume and an end surface opposite the floor;

c) the end surfaces of the side walls defining an opening in the body;

d) a cover covering the opening in the body, the cover having an inside surface facing the interior volume;

e) a channel formed in the cover inside surface; and f) a means for covering the channel to form a passage, the passage having an inlet and an outlet.

9. An internal combustion engine, as recited in claim 8, wherein the means for covering the channel comprises a plate covering the channel and a means for securing the plate to the inside surface of the cover.

10. An internal combustion engine, as recited in claim 9, wherein means for securing the plate to the inside surface of the cover comprises:

a) a fastening aperture in the plate;

b) an internally threaded aperture in the inside surface, aligned with the fastening aperture; and c) a threaded member, inserted through the fastening aperture, and threaded into the internally threaded aperture to secure the plate to the inside surface of the cover.

11. An internal combustion engine, as recited in claim 9, wherein the plate does not completely seal the channel.

12. An internal combustion engine, as recited in claim 9, wherein the inlet comprises an aperture in the passage.

13. An internal combustion engine, as recited in claim 9, wherein the outlet comprises an aperture in the passage.

14. An internal combustion engine, as recited in claim 8, wherein the channel is formed by a plurality of walls extending from the cover inside surface.

15. An internal combustion engine, as recited in claim 8, wherein the passage allows the flow of fluid through the passage from the inlet to the outlet.

16. An internal combustion engine, as recited in claim 8, wherein the means for covering the channel does not completely seal the channel.

17. A crankcase top for an internal combustion engine, said top comprising:

a) a body having a first surface and a channel formed in the body and located within the first surface;

b) a means for covering the channel to form a passage, the passage having an inlet and an outlet, the means for covering including a second surface that interfaces the first surface when the means for covering is covering the channel, wherein at least one of at least a first portion of the first surface and at least a second portion of the second surface is configured to be a crankcase interior surface.

18. A crankcase top, as recited in claim 17, wherein the means for covering the channel comprises a plate covering the channel and a means for securing the plate to the body.

19. A crankcase top, as recited in claim 18, wherein the means for securing the plate to the body comprises:

a) a fastening aperture in the plate;

b) an internally threaded aperture in the body, aligned with the fastening aperture; and c) a threaded member, inserted through the fastening aperture, and threaded into the internally threaded aperture to secure the plate to the body.

20. A crankcase top, as recited in claim 18, wherein the plate does not completely seal the channel.

21. A crankcase top, as recited in claim 18, wherein the inlet comprises an aperture in the passage.

22. A crankcase top, as recited in claim 18, wherein the outlet comprises an aperture in the passage.

23. A crankcase top, as recited in claim 17, wherein the channel is formed by a plurality of walls extending from the surface of the body.

24. A crankcase top, as recited in claim 17, wherein the passage allows the flow of fluid from the inlet to the outlet.

25. A crankcase top, as recited in claim 17, wherein the means for covering the channel does not completely seal the channel.

26. A crankcase having the top as recited claim 17, wherein the top is removably coupled to a remainder of the crankcase.

27. A crankcase, as recited in claim 26, wherein at least one of the body and the means for covering is in contact with the remainder of the crankcase when the top is coupled to the remainder of the crankcase.

28. A crankcase top, as recited in claim 17, wherein the means for covering includes an additional channel.

29. A method of assembling an engine crankcase comprising:

assembling the means for covering and the body to form the top as recited in claim 17; and coupling the top to a remainder of the engine crankcase.

* * * * *

UNITED STATES PATENT AND TRADEMARK OFFICE

CERTIFICATE OF CORRECTION

PATENT NO. : 6,837,206 B2
DATED : January 4, 2005
INVENTOR(S) : Bonde et al.

It is certified that error appears in the above-identified patent and that said Letters Patent is hereby corrected as shown below:

Column 5,
Line 45, "emodiments" is changed to -- embodiments --

Signed and Sealed this

Twenty-fourth Day of May, 2005

JON W. DUDAS
*Director of the United States Patent and Trademark Office*